US010550452B2

(12) United States Patent
Liao et al.

(10) Patent No.: US 10,550,452 B2
(45) Date of Patent: Feb. 4, 2020

(54) HIGH CREEP RESISTANT EQUIAXED GRAIN NICKEL-BASED SUPERALLOY

(71) Applicant: NATIONAL CHUNG SHAN INSTITUTE OF SCIENCE AND TECHNOLOGY, Taoyuan (TW)

(72) Inventors: Chien-Hung Liao, Taoyuan (TW); Hui-Yun Bor, Taoyuan (TW); Cuo-Yo Nieh, Taoyuan (TW); Chao-Nan Wei, Taoyuan (TW); Sz-Hen Chen, Taoyuan (TW); Po-Han Chu, Taoyuan (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 305 days.

(21) Appl. No.: 15/633,989

(22) Filed: Jun. 27, 2017

(65) Prior Publication Data

US 2018/0371582 A1 Dec. 27, 2018

(51) Int. Cl.

| | |
|---|---|
| ***C22C 19/05*** | (2006.01) |
| ***C22C 1/02*** | (2006.01) |
| ***C22F 1/10*** | (2006.01) |
| ***C22F 1/02*** | (2006.01) |
| ***C22F 1/00*** | (2006.01) |
| ***B22D 18/06*** | (2006.01) |

(52) U.S. Cl.
CPC ..... *C22C 19/057* (2013.01); *B22D 18/06* (2013.01); *C22C 1/023* (2013.01); *C22F 1/002* (2013.01); *C22F 1/02* (2013.01); *C22F 1/10* (2013.01)

(58) Field of Classification Search
CPC ..... C22C 19/057; C22C 19/023; C22F 1/10; C22F 1/002; C22F 1/02; B22D 18/06
See application file for complete search history.

(56) References Cited

U.S. PATENT DOCUMENTS 4,719,080 A * 1/1988 Duhl ..... C30B 11/00 148/404
6,007,645 A * 12/1999 Cetel ..... C22C 19/057 148/404

* cited by examiner

*Primary Examiner* — C Melissa Koslow
(74) *Attorney, Agent, or Firm* — Schmeiser, Olsen & Watts, LLP

(57) ABSTRACT

A high creep-resistant equiaxed grain nickel-based superalloy. The high creep-resistant equiaxed grain nickel-based superalloy is characterized that the chemical compositions in weight ratios include Cr in 8.0 to 9.5 wt %, W in 9.5 to 10.5 wt %, Co in 9.5 to 10.5 wt %, Al in 5.0 to 6.0 wt %, Ti in 0.5 to 1.5 wt %, Mo in 0.5 to 1.0 wt %, Ta in 2.5 to 4.0 wt %, Hf in 1.0 to 2.0 wt %, Ir in 2.0 to 4.0 wt %, C in 0.1 to 0.2 wt %, B in 0.01 to 0.1 wt %, Zr in 0.01 to 0.10 wt %, and the remaining part formed by Ni and inevitable impurities.

4 Claims, No Drawings

HIGH CREEP RESISTANT EQUIAXED GRAIN NICKEL-BASED SUPERALLOY

BACKGROUND OF THE INVENTION

Field of the Invention

The present invention relates to a nickel-based alloy, and more particularly to a high creep-resistant equiaxed grain nickel-based superalloy.

Description of the Prior Art

Nickel features high strength, corrosion resistance and oxidation resistance at high temperatures, and is thus one of the most extensively applied high temperature resistant materials in current advanced turbo engines. Conventionally, three main methods for forming a nickel-based superalloy include casting, forging and powder metallurgy. Among the above methods, casting technology offers an advantage of being capable of manufacturing workpieces having complicated shapes, and is thus commonly selected for manufacturing workpieces having complicated shapes in practice. There are currently two methods for increasing application temperatures of a nickel-based superalloy. In the first method, the composition of the alloy is modified. For example, in the conventional casting process, using a Mar-M247 superalloy (having an equiaxed grain microstructure) allows the nickel-based superalloy to have a quite high application temperature. However, to further improve the temperature resistance of a superalloy, in addition to modifying the alloy design, improvements may also be made from the perspective of the conventional casting. For example, based on the Bridgeman method, the ambient temperature gradient is controlled at one single direction to form a directional solidification crystal (DC) or single crystal (SC) structure during the solidification process, hence further increasing the application temperature of the nickel-based superalloy.

Compared to directional solidification crystals or single crystals, the temperature resistance of equiaxed grain alloys is lower. However, the directional solidification crystal or single crystal casting processes can only be used for fabricating simple shaped castings (e.g., turbo blades). Thus, complex and integrated components such as turbo rotors used in turbo engines need to be manufactured from equiaxed grain alloys using the conventional equiaxed grain casting. Further, the production speed and manufacturing costs of conventional equiaxed grain casting are also better than those of directional solidification crystal or single crystal castings. Therefore, the conventional equiaxed grain casting is still one of the main methods for manufacturing high performance nickel-based superalloy castings.

Creep is a process that gradually produces plastic deformation under high temperature and stress, and is one main factor causing damages of a material under high temperature. Turbo engines, applied in aviation industries, particularly require good creep resistance under high temperature environments. Therefore, there is a need for a solution for manufacturing an excellent highly creep resistant nickel-based superalloy, so as to provide a highly creep resistant nickel-based superalloy concurrently satisfying both cost effectiveness and mechanical characteristics.

SUMMARY OF THE INVENTION

In view of the above issues, it is a primary object of the present invention to provide a high creep-resistant equiaxed grain nickel-based superalloy. More specifically, the vacuum melting and vacuum casting processes as well as the addition of appropriate elements are integrated in the present invention to manufacture a high creep-resistant equiaxed grain nickel-based superalloy.

To achieve the above object, a high creep-resistant equiaxed grain nickel-based superalloy is provided according to a solution of the present invention. The chemical compositions of the high creep-resistant equiaxed grain nickel-based superalloy in weight ratios are as follows: Cr in 8.0 to 9.5 wt %, W in 9.5 to 10.5 wt %, Co in 9.5 to 10.5 wt %, Al in 5.0 to 6.0 wt %, Ti in 0.5 to 1.5 wt %, Mo in 0.5 to 1.0 wt %, Ta in 2.5 to 4.0 wt %, Hf in 1.0 to 2.0 wt %, Ir in 2.0 to 4.0 wt %, C in 0.1 to 0.2 wt %, B in 0.01 to 0.1 wt %, Zr in 0.01 to 0.10 wt %, and the remaining part are formed by Ni and inevitable impurities.

The above high creep-resistant equiaxed grain nickel-based superalloy is melted by a vacuum induction melting furnace. Next, vacuum investment casting is performed in a vacuum environment, in which a molten alloy is poured into a ceramic mold. After the cooling process, nickel-based superalloy ingot is made.

The nickel-based superalloy ingot with an equiaxed grain structure needs a further heat treatment, in which the nickel-based superalloy is processed by a two-stage heat treatment of the present invention. In the first-stage heat treatment, the nickel-based superalloy ingot is heat treated by 1100 to 1300° C. for at least one hour and then quenched by an inert gas (e.g., argon). In the second-stage heat treatment, the nickel-based superalloy ingot is heat treated by 800 to 1000° C. for at least ten hours and then furnace cooled to room temperature to manufacture the high creep-resistant equiaxed grain nickel-based superalloy.

The above description and following details are given to further illustrate the methods, means and effects for achieving the objects of the present invention. Other objects and advantages of the present invention are further given in the following description and the accompanying drawings.

DETAILED DESCRIPTION OF THE EMBODIMENTS

Specific embodiments below are given to explain implementation details of the present invention for one person skilled in the art to better understand the advantages and effects of the present invention based on the disclosure of the specification.

The alloy design of the present invention is based on a nickel-based superalloy having an equiaxed grain structure, and elements including aluminum (Al) and titanium (Ti) are added thereto. By using the γ' precipitation hardening phase of $Ni_3(Al, Ti)$ formed from Al, Ti and Ni, the high-temperature mechanical strength of the alloy is reinforced. However, if the amount of γ' phase becomes excessive, the brittleness of the alloy may increase to induce the brittle fracture of the alloy during the casting or application process. Thus, the amount of Al in the nickel-based superalloy of the present invention is between 5.0 to 6.0 wt %, and the amount of Ti is between 0.5 to 1.5 wt %. When a nickel-based superalloy is used in a high temperature over an extended period of time, coarsening of the γ' phase increases with time and the volume fraction of the γ' phase gradually decreases, such that the strength of the nickel-based superalloy is lowered. To improve this issue, the present invention adds Ta into the alloy, which is beneficial for increasing the stability of the γ' phase at a high temperature. However, with an excessive amount of Ta added, a large and thick TaC-type carbide is easily produced. The TaC-type carbide is susceptible to being a crack initial site, causing the strength reduction of the alloy. Thus, in the present invention, the amount of Ta in the nickel-based superalloy is controlled between 2.5 to 4.0 wt %. Co in the present invention plays a role of increasing the solidus temperature of the γ' phase as well as reducing solubility of Al and Ti in the γ matrix to increase the amount of the γ' precipitation phase. Accordingly, the high-temperature strength of the alloy can be increased. However, after adding a certain amount of Co, the effect of increasing the amount of γ' phase becomes less obvious. Further, although Co provides a solid solution strengthening effect, it may become less apparent because the atom sizes of Co and Ni are about the same. Thus, the amount of Co of the nickel-based superalloy of the present invention is controlled between 9.5 to 10.5 wt %. In the superalloy of the present invention, C together with other alloy elements may form a carbide having an extremely high atomic bonding strength. The carbide mainly plays the role of grain boundary strengthening, which is beneficial for suppressing the grain-boundary sliding at a high temperature to further increase the lifetime of creep. However, when given an excessive amount of C, a large-size block-like or strip-like MC-type carbide (where M represents metal atoms and C represents carbon atoms) may be easily formed, such that the carbide is susceptible to being a crack initial site. Further, an excessive amount of carbon further reduces the incipient melting temperature of the alloy. To prevent the formation of the incipient melting phase, lower solid solution temperature needs to be adopted, which, however, causes a degraded result in strengthening the alloy through a heat treatment after the alloy casting process. Thus, the amount of carbon in the nickel-based superalloy of the present invention needs to be between 0.1 to 0.2 wt %. In this experiment, Cr serves a main purpose of increasing the oxidation resistance and thermal corrosion resistance of the alloy. However, in the present invention, in addition to providing the above advantages, Cr in the alloy is a main element to form the $M_{23}C_6$ carbide. Through a series of experiments, it is discovered that the amount of Cr in the nickel-based superalloy of the present invention needs to be limited between 8.0 to 9.5 wt %. In the present invention, Hf provides a main effect of forming a large amount of γ-γ' rose-like eutectic structures. This type of eutectic structures has good toughness. They can be precipitated at the grain boundaries to prevent cracks from high-speed expanding to thereby toughen the grain boundaries. However, large and thick HfC-type carbide may be produced if too much Hf is added, and such type of carbide is susceptible to being a crack initial site. As a result, that the strength of the alloy is reduced. Thus, in the present invention, the amount of Hf in the nickel-based superalloy needs to be controlled between 1.0 to 2.0 wt %. In the present invention, Mo and W are capable of increasing the stable temperature of the γ' phase, i.e., the dissolution temperature of the γ' phase. However, adding too much Mo and W may cause non-uniform chemical composition of the alloy. It may even form a harmful topologically-close-packed (TCP) phase in the alloy in severe cases. The TCP phase is an extremely brittle phase, and easily results in concentration in stress due to dislocation accumulation to become susceptible to being a crack initial site. As a result, the strength of a material is reduced. Further, the TCP phase, when formed, consumes a large amount of solid solution strengthening elements in the γ matrix such that the strength of the γ matrix is reduced. In the present invention, an appropriate amount of Ir is added to increase the chemical composition uniformity of the alloy and to suppress the formation of the TCP phase. Further, adding Ir may also promotes solid solution strengthening of the alloy and increases the stability of the γ' phase at a high temperature. Based on the considerations above, in the present invention, the amounts of Mo, W and Ir in the nickel-based superalloy needs to be limited between 0.5 to 1.0 wt %, 9.5 to 10.5 wt %, and 2 to 4 wt % respectively. B and Zr which mainly provide effects of grain boundary strengthening, offer effects of purification and strengthening grain boundaries when added by a small amount. However, if B and Zr are added in excess, it may weaken the grain boundaries and form various harmful structures to reduce the strength of the alloy. Thus, in the present invention, the amounts of B and Zr in the nickel-based superalloy are appropriately controlled between 0.01 to 0.1 wt %.

According to the above experimental results, the present invention develops a high creep-resistant equiaxed grain nickel-based superalloy, whose chemical compositions (in weight ratios, wt %) include: Cr in 8.0 to 9.5 wt %, W in 9.5 to 10.5 wt %, Co in 9.5 to 10.5 wt %, Al in 5.0 to 6.0 wt %, Ti in 0.5 to 1.5 wt %, Mo in 0.5 to 1.0 wt %, Ta in 2.5 to 4.0 wt %, Hf in 1.0 to 2.0 wt %, Ir in 2.0 to 4.0 wt %, C in 0.1 to 0.2 wt %, B in 0.01 to 0.1 wt %, Zr in 0.01 to 0.10 wt %, and the remaining part formed by Ni and inevitable impurities.

First Embodiment

The nickel-based superalloy of the present invention is melted in a vacuum induction melting furnace according to the chemical composition ratios (as shown in Table-1) and then processed by vacuum investment casting in which the molten alloy is poured in a ceramic mold.

TABLE 1

Alloy components of first embodiment

| Element | Cr | Co | Mo | W | Ta | Al | Ti | Ir | Hf | C | B | Zr | Ni |
|---|---|---|---|---|---|---|---|---|---|---|---|---|---|
| wt. % | 9.44 | 10.1 | 0.79 | 10.3 | 3.8 | 5.34 | 0.91 | 3.04 | 1.33 | 0.15 | 0.019 | 0.05 | Rem. |

After casting, the nickel-based alloy needs to be heat treated to optimize microstructures in the alloy. The heat treatment includes: 1) subjected to a vacuum solid solution treatment at 1100 to 1300° C. for at least one hour and then quenched by argon to room temperature; and 2) subjected to a vacuum aging treatment at 800 to 1000° C. for at least ten hours, and then furnace cooled to room temperature. After the heat treatment, the creep test is conducted at 982° C./200 MPa. The test results are as shown in Table-2:

TABLE 2

Creep performance of first embodiment

| Rupture lifetime (hour) | t1% (hour) | t2% (hour) | Elongation (%) |
|---|---|---|---|
| 121.3 | 48.6 | 71.6 | 15.0 |

Second Embodiment

The nickel-based superalloy of the present invention is melted in a vacuum induction melting furnace according to chemical composition ratios (as shown in Table-3) and then processed by vacuum investment casting in which the molten alloy is poured in a ceramic mold.

TABLE 3

| Alloy components of second embodiment | | | | | | | | | | | | | |
|---|---|---|---|---|---|---|---|---|---|---|---|---|---|
| Element | Cr | Co | Mo | W | Ta | Al | Ti | Ir | Hf | C | B | Zr | Ni |
| wt. % | 8.38 | 9.88 | 0.72 | 9.83 | 2.92 | 5.49 | 0.97 | 2.12 | 1.32 | 0.15 | 0.017 | 0.05 | Rem. |

After casting, the nickel-based alloy needs to be heat treated to optimize microstructures in the alloy. The heat treatment includes: 1) subjected to a vacuum solid solution treatment at 1100 to 1300° C. for at least one hour, and then quenching by argon to room temperature; and 2) subjected to a vacuum aging treatment at 800 to 1000° C. for at least ten hours, and then furnace cooled to room temperature. After the heat treatment, the creep test is conducted at 982° C./200 MPa. The test results are as shown in Table-4:

TABLE 4

| Creep performance of second embodiment | | | |
|---|---|---|---|
| Rupture Lifetime (hour) | t1% (hour) | t2% (hour) | Elongation (%) |
| 102.7 | 34.8 | 57.0 | 13.8 |

Currently, the most common commercial equiaxed nickel-based superalloys include Mar-M247, In713LC and In718 alloys, among which the Mar-M247 alloy has optimum high-temperature creep performance. Thus, the Mar-M247 alloy is selected as a comparison reference in the present invention, and the creep test conditions at 982° C./200 MPa are selected with reference to EMS55447 aviation material specifications of the Mar-M247 alloy. Because the EMS55447 specifications do not specify standards of t1% and t2%, an alloy conforming to the chemical composition specifications of the Mar-M247 alloy is manufactured according to the manufacturing conditions of this embodiment. The creep-related data is supplemented in Table-5, wherein t1% and t2% refer to creep time at which the elongation of the material reaches 1% and t2% respectively. After comparing the creep property of the alloy of the present invention with that of the Mar-M247 alloy, the results show that the alloy of the present invention provides best performance in aspects of creep lifetime and creep resistance ability (t1%, t2%). The elongation of the alloy of the present invention does not differ much from that of the Mar-M247 alloy. Though it still meets the EMS 55447 specifications. Therefore, the inventive step in the creep performance of the alloy of the present invention is quite obvious.

TABLE 5

| Creep performance of compared embodiment | | | | |
|---|---|---|---|---|
| | Rupture Lifetime (hour) | t1% (hour) | t2% (hour) | Elongation (%) |
| EMS 55447 | >25 | — | — | >4 |
| Mar-M247 | 37.4 | 14.6 | 22.2 | 15.6 |

While the invention has been described in terms of what is presently considered to be the most practical and preferred embodiments, it is to be understood that the invention is only illustrative and needs not to be limited to the above embodiments. It should be noted that equivalent variations and replacements made to the embodiments are to be encompassed within the scope of the present invention. Therefore, the scope of the present invention is to be accorded with the appended claims.

What is claimed is:

1. A high creep-resistant equiaxed grain nickel-based superalloy, having the chemical compositions in weight ratios of:

Cr in 8.0 to 9.5 wt %, W in 9.5 to 10.5 wt %, Co in 9.5 to 10.5 wt %, Al in 5.0 to 6.0 wt %, Ti in 0.5 to 1.5 wt %, Mo in 0.5 to 1.0 wt %, Ta in 2.5 to 4.0 wt %, Hf in 1.0 to 2.0 wt %, Ir in 2.0 to 4.0 wt %, C in 0.1 to 0.2 wt %, B in 0.01 to 0.1 wt %, Zr in 0.01 to 0.10 wt %, and a remaining part formed by Ni and inevitable impurities.

2. The high creep-resistant equiaxed grain nickel-based superalloy according to claim 1, is melted by a vacuum induction melting furnace.

3. The high creep-resistant equiaxed grain nickel-based superalloy according to claim 1, is casted in a vacuum environment.

4. The high creep-resistant equiaxed grain nickel-based superalloy according to claim 3, is processed by a first-stage and a second-stage heat treatment, and wherein the first-stage heat treatment is a heat treatment performed in vacuum at a temperature of 1100 to 1300° C. for least 1 hour and then quenched to room temperature by an inert gas, and wherein the second-stage heat treatment is a vacuum aging treatment performed at a temperature of 800 to 1000° C. for at least 10 hours and then furnace cooled to room temperature.

* * * * *